US010456313B2

(12) United States Patent
Zakar

(10) Patent No.: US 10,456,313 B2
(45) Date of Patent: Oct. 29, 2019

(54) CREMATION URN

(71) Applicant: Robert Hani Zakar, San Diego, CA (US)

(72) Inventor: Robert Hani Zakar, San Diego, CA (US)

( * ) Notice: Subject to any disclaimer, the term of this patent is extended or adjusted under 35 U.S.C. 154(b) by 0 days.

(21) Appl. No.: 15/870,995

(22) Filed: Jan. 14, 2018

(65) Prior Publication Data

US 2019/0216668 A1 Jul. 18, 2019

(51) Int. Cl.

| | |
|---|---|
| ***A61G 17/08*** | (2006.01) |
| ***B65D 21/02*** | (2006.01) |
| *B65D 1/22* | (2006.01) |

(52) U.S. Cl.

CPC ..... *A61G 17/08* (2013.01); *B65D 21/0233* (2013.01); *B65D 1/22* (2013.01)

(58) Field of Classification Search

CPC ..... A61G 17/08; B65D 21/0233; B65D 1/22
USPC ..... 27/1; 206/505
See application file for complete search history.

(56) References Cited

U.S. PATENT DOCUMENTS 3,568,878 A * 3/1971 Fotos ..... B65D 1/26 206/520
3,696,987 A * 10/1972 Schuff ..... B65D 1/265 229/400
3,739,939 A * 6/1973 Koenig ..... B65D 21/0233 206/518
4,082,184 A * 4/1978 Hammer ..... B65D 1/22 206/519
4,951,832 A 8/1990 Tenney et al.
5,281,073 A 1/1994 Gesaule
5,287,603 A * 2/1994 Schorman ..... A61G 17/08 27/1
5,740,637 A * 4/1998 Snow ..... E04H 13/006 27/1
6,052,954 A * 4/2000 Dudek ..... A61G 17/08 27/7
6,167,600 B1 * 1/2001 Williams ..... E04H 13/006 27/1
6,484,457 B1 * 11/2002 Dudek ..... E04H 13/00 27/7
6,874,650 B2 4/2005 Welsh et al.
7,216,769 B2 5/2007 Palder
7,467,444 B1 * 12/2008 Johnson, Sr. ..... A44C 23/00 27/1
7,726,483 B2 6/2010 Ramanujam et al.
(Continued)

FOREIGN PATENT DOCUMENTS

KR 2003-552416 * 4/2003

*Primary Examiner* — William L Miller
(74) *Attorney, Agent, or Firm* — Mastrogiacomo PLLC

(57) ABSTRACT

A cremation urn for storing cremated remains is provided. The urn includes a base, a front wall, a rear wall, a pair of side walls a top opening, an interior cavity for receiving the cremated remains, four corner beads configured at the intersection of the front wall to the side walls and the rear wall to the side walls and the corner beads extending from the base to the top opening and a plurality of stops positioned a distance above the base and secured at each of the corner beads within the interior cavity. The front wall, the rear wall and the side walls extend generally upward at outward angles from the base to the top opening to create a taper in the urn. The tapering of walls enables a second cremation urn to be nested freely within the interior cavity of the urn.

3 Claims, 20 Drawing Sheets

(56) References Cited

U.S. PATENT DOCUMENTS

| | | | | |
|---|---|---|---|---|
| 8,245,847 | B2 | 8/2012 | Davis | |
| 9,056,040 | B2 | 6/2015 | Gesell et al. | |
| 9,663,269 | B1 | 5/2017 | Lasris | |
| 9,682,799 | B2 | 6/2017 | Gosen et al. | |
| 9,694,837 | B2 | 7/2017 | Ryan | |
| 9,718,582 | B2 | 8/2017 | Hylton | |
| 9,731,862 | B2 * | 8/2017 | Mays | B65D 21/0233 |
| 2003/0145533 | A1 * | 8/2003 | Dudek | E04H 13/00 52/128 |
| 2004/0118737 | A1 * | 6/2004 | Welsh | B65D 21/0222 206/508 |
| 2005/0193335 | A1 | 9/2005 | Davis et al. | |
| 2009/0050508 | A1 * | 2/2009 | Van Ness | B65D 21/0233 206/515 |
| 2009/0107998 | A1 * | 4/2009 | Meissen | B65D 21/0233 220/254.3 |
| 2009/0199376 | A1 * | 8/2009 | Hume | E04H 13/006 27/1 |
| 2013/0185907 | A1 * | 7/2013 | Langelier | A61G 17/08 27/1 |
| 2014/0190861 | A1 | 7/2014 | Carrel et al. | |
| 2014/0209500 | A1 * | 7/2014 | Mays | B65D 21/0233 206/515 |
| 2017/0166363 | A1 * | 6/2017 | Ng | B65D 43/162 |

* cited by examiner

CREMATION URN

CROSS REFERENCE TO RELATED APPLICATIONS

Not Applicable

STATEMENT REGARDING FEDERALLY SPONSORED RESEARCH OR DEVELOPMENT

Not Applicable

INCORPORATION-BY-REFERENCE OF MATERIAL SUBMITTED ON COMPACT DISC

Not Applicable

BACKGROUND OF THE INVENTION

1. Field of the Invention

The present invention relates generally to a cremation urn and, more particularly, to an improvement in the design of the urn to enable efficient packaging for shipping and storage of urns prior to use.

2. Background Art

As burial costs continue to rise and land for burial plots becomes more of a premium, an alternative to the traditional Judeo-Christian burial method is beginning to gain popularity. Cremations are on the rise around the world. In the United States, cremations have risen from less than 4% in the 1950s to over 40% in the 2010s. On average, cremations are less costly than traditional casket burial methods and may be more convenient. Cremations require less preparation on the part of the funeral director to ready the body for a wake ceremony and subsequent burial in the ground or mausoleum.

Presently, temporary cremation urns are used to house the remains of a cremated body while a permanent urn or other solution for the remains are identified. Temporary urns need to be capable of storing and protecting cremated remains from water and other elements. Urns include a lid that may be used to seal a top opening of an urn to prevent the cremated remains from spilling if the urn is knocked over on its side. Temporary urns are typically manufactured of a plastic composite, such as polypropylene and the like, are very light in weight and capable of withstanding moisture. Although the urn may be temporary, it is so in name alone. The urn must be capable of safely and securely storing cremated remains for a period of a few days to several months to an eternity.

With the popularity of cremations ever increasing, there is a rising need for temporary urns. The present design of the temporary urn is such that it is only capable of being stacked during shipment and storage. The outside dimensions of a typical temporary urn are approximately 8.5 inches in height, 6.5 inches in width and 4.5 inches deep. Urns may be shipped to crematories in standard corrugated cardboard boxes. The typical dimensions of a shipping box may be approximately 18 inches in height, 26 inches in width and 20 inches in depth. A shipping box of that size may house 36 temporary urns stacked two high within the box. While an urn is relatively light in weight at 0.75 pounds, the urn displaces approximately 250 cubic inches of volume. Shipping a box of 36 temporary urns displaces over 9,000 cubic inches or over 5.4 cubic feet of volume and weighs approximately 28 pounds.

Shipping and delivery companies often find that shipping boxes having these dimensions and weight is difficult to handle due to the rather large size and awkward dimensions of the shipping boxes. As a consequence, the cost of shipping temporary urns in boxes of this size may be quite high and erode business profits. Of course smaller boxes may be used to ship smaller quantities of temporary urns, but more shipments would be required, thus still driving up costs. Furthermore, crematories also face the added cost of storing the temporary urns at their place of business. Therefore, a need exists for a cremation urn that is configured to be stackable and nestable, yet maintain a similar volume to prior art urns, to facilitate easier and ultimately less costly shipping and storage of urns for those offering cremation and funeral services.

BRIEF SUMMARY OF THE INVENTION

A cremation urn for storing cremated remains is provided. The cremation urn includes a base, the base including an edge that extends a perimeter of the base, a front wall, the front wall extending generally upward at a first outward angle from the edge of the base, a rear wall, the rear wall extending generally upward at a second outward angle from the edge of the base, the rear wall opposite the front wall, a first side wall extending generally upward at a third outward angle from the edge of the base, the first side wall intersecting the front wall and the rear wall, a second side wall extending generally at a fourth outward angle upward from the edge of the base, the second side wall opposite the first side wall and the second side wall intersecting the front wall and the rear wall, a top opening, the top opening created at a top of the front wall, the rear wall, the first side wall and the second side wall, a lid, the lid covering the top opening, a hinge, the hinge connected to the lid and the rear wall, an interior cavity for receiving the cremated remains, the interior cavity created by the interior intersection of the front wall to the first side wall, the front wall to the second side wall, the rear wall to the first side wall, the rear wall to the second side wall and each of the front wall, the first side wall, the second side wall and the rear wall intersecting the edge of the base, four corner beads, each of the corner beads configured at the intersection of the front wall to the side walls and the rear wall to the side walls and each of the four corner beads extending from the base to the top opening; a plurality of stops, the plurality of stops positioned a distance above the base and the plurality of stops fixedly secured to each of the corner beads within the interior cavity and the plurality of stops including a rounded edge and wherein the front wall, the rear wall, the first side wall and the second side wall extend generally upward at said first outward angle, said second outward angle, said third outward angle and said fourth outward angle respectively from the base to the top opening to create a taper in the cremation urn, wherein the tapering of the front wall, the rear wall, the first side wall and the second side wall enable a second cremation urn to pass through the top opening of the cremation urn to be nested within the interior cavity of the cremation urn, wherein a second edge of a second base of the second cremation urn engages the plurality of stops of the cremation urn to facilitate the nesting and unnesting of multiple cremation urns wherein the second cremation urn rests freely within the interior cavity abutting the plurality of stops of the cremation urn to further facilitate the effortless removal of the second cremation urn from the interior cavity of the cremation urn.

BRIEF DESCRIPTION OF THE SEVERAL VIEWS OF THE DRAWINGS

The features and inventive aspects of the present invention will become more apparent from the following detailed description, claims, and drawings, of which the following is a brief description:

DETAILED DESCRIPTION OF THE INVENTION

Figure 1:
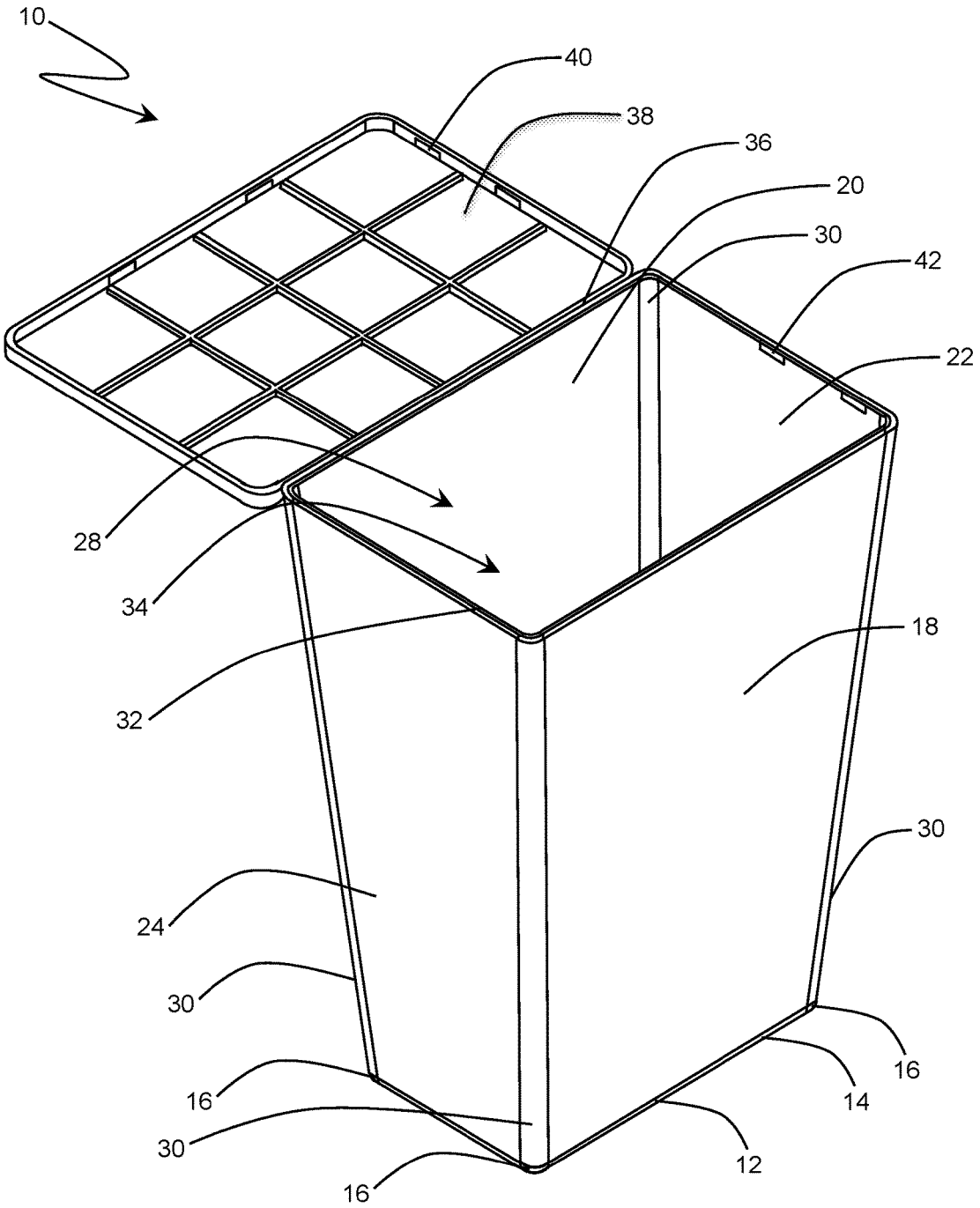
FIG. 1 is a perspective view of a cremation urn according to an embodiment of the present invention.

Referring now to the drawings, preferred illustrative embodiments of the present invention are shown in detail. Although the drawings represent embodiments of the present invention, the drawings are not necessarily to scale and certain features may be exaggerated to better illustrate and explain the present invention. Further, the embodiments set forth herein are not intended to be exhaustive or otherwise to limit or restrict the invention to the precise forms and configurations shown in the drawings and disclosed in the following detailed description.

A cremation urn 10 is depicted in FIGS. 1-16. Urns are configured to store the cremated remains of what was once a living organism such as a human, animal and the like. Storing cremated remains of loved ones in urns is an alterative to the interment of an intact dead body in a casket and burial in memorial sites. Cremation has been gaining popularity over the last several years due to convenience and cost savings over traditional burial methods.

According to an embodiment of the present invention, cremation urn 10 includes a base 12 as show in FIGS. 2-9 and 12-16. Base 12 is generally flat and includes an edge 14 that extends an outer perimeter of base 12. Edge 14 may be rounded, straight or similar configuration at each of the four corners 16 of base 12. Edge 14 may include a lip 26 that extends generally downward from base 12 and provides a stable foundation for urn 10.

A front wall 18 may extend generally upward from base 12 at edge 14. A rear wall 20 may extend generally upward from base 12 at edge 14 as well. Rear wall 20 may extend generally upward from base 12 at an opposite edge 14 from front wall 18 such that rear wall 20 and front wall 18 extend from generally upward from opposite sides of base 12. Side walls 22, 24 may also extend generally upward from base 12 at edge 14 such that side wall 22 is opposite from side wall 24. Side walls 22, 24 are generally perpendicular to front wall 18 and rear wall 20 and intersect front wall 20 and rear wall 22 to create an interior cavity 28 of urn 10. Rounded corner beads 30 may extend generally upward from each of four corners 16 to create the intersections of front wall 20 to side walls 22, 24 and rear wall 20 to side walls 22, 24.

A top of portion of each of front wall 18, rear wall 20 and side walls 22, 24 are configured to create a rim 32 that extends the upper perimeter of urn 10. Rim 32 provides a top opening 34 into interior cavity 28 of urn 10. A hinge 36 extends outward from rear wall 20 to a lid 38. Lid 38 is sized to engage rim 32 and cover opening 34 completely. Hinge 36 allows lid to move freely about rear wall 20 from a closed position to an open position relative to opening 34. Lid 38 may include locking tabs 40 and rim 32 may include corresponding locking slots 42 to accept tabs 40 such that when lid 38 is in a closed position, tabs 40 of lid 38 engage slots 42 of rim 32 to seal internal cavity 28 of urn 10. Although the present embodiment describes the use of tabs 40 and slots 42 to secure lid 38 to rim 32, it is important to note, however, that any means of securing lid 38 to rim 32 may be used to seal internal cavity 28 of urn 10.

Figure 2:
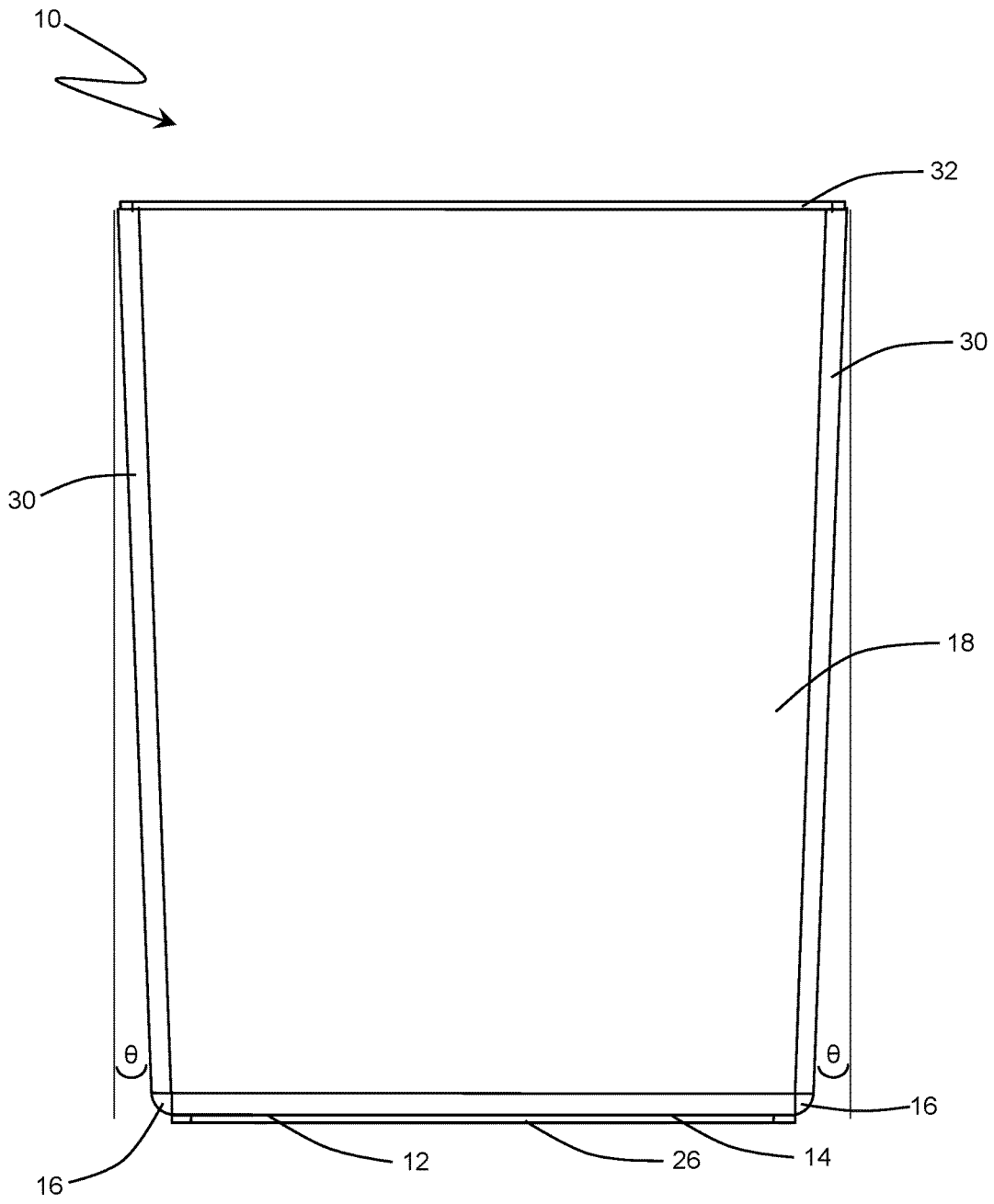
FIG. 2 is a front view of the cremation urn according to an embodiment of the present invention.
Figure 3:
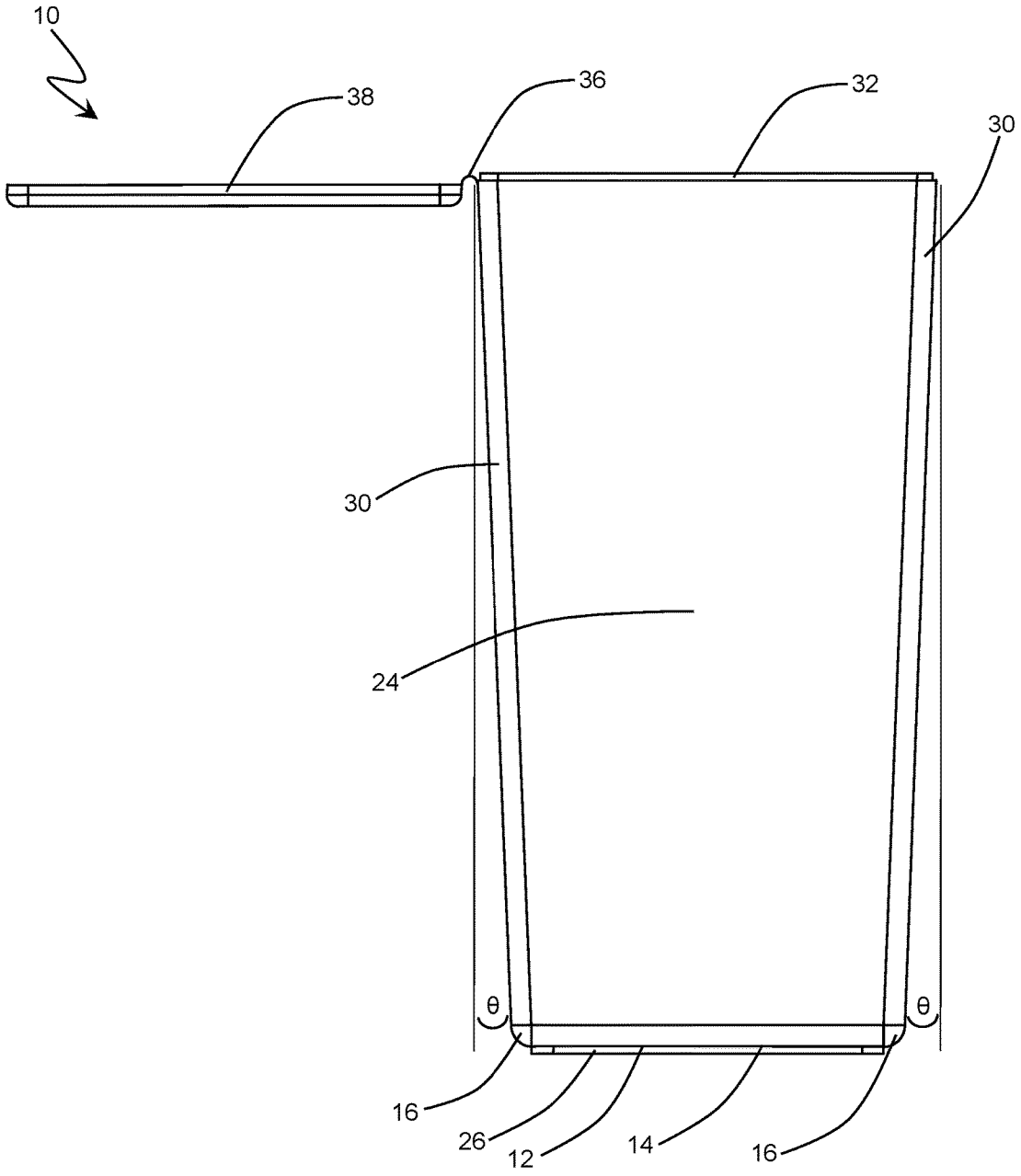
FIG. 3 is a first side view of the cremation urn according to an embodiment of the present invention.
Figure 4:
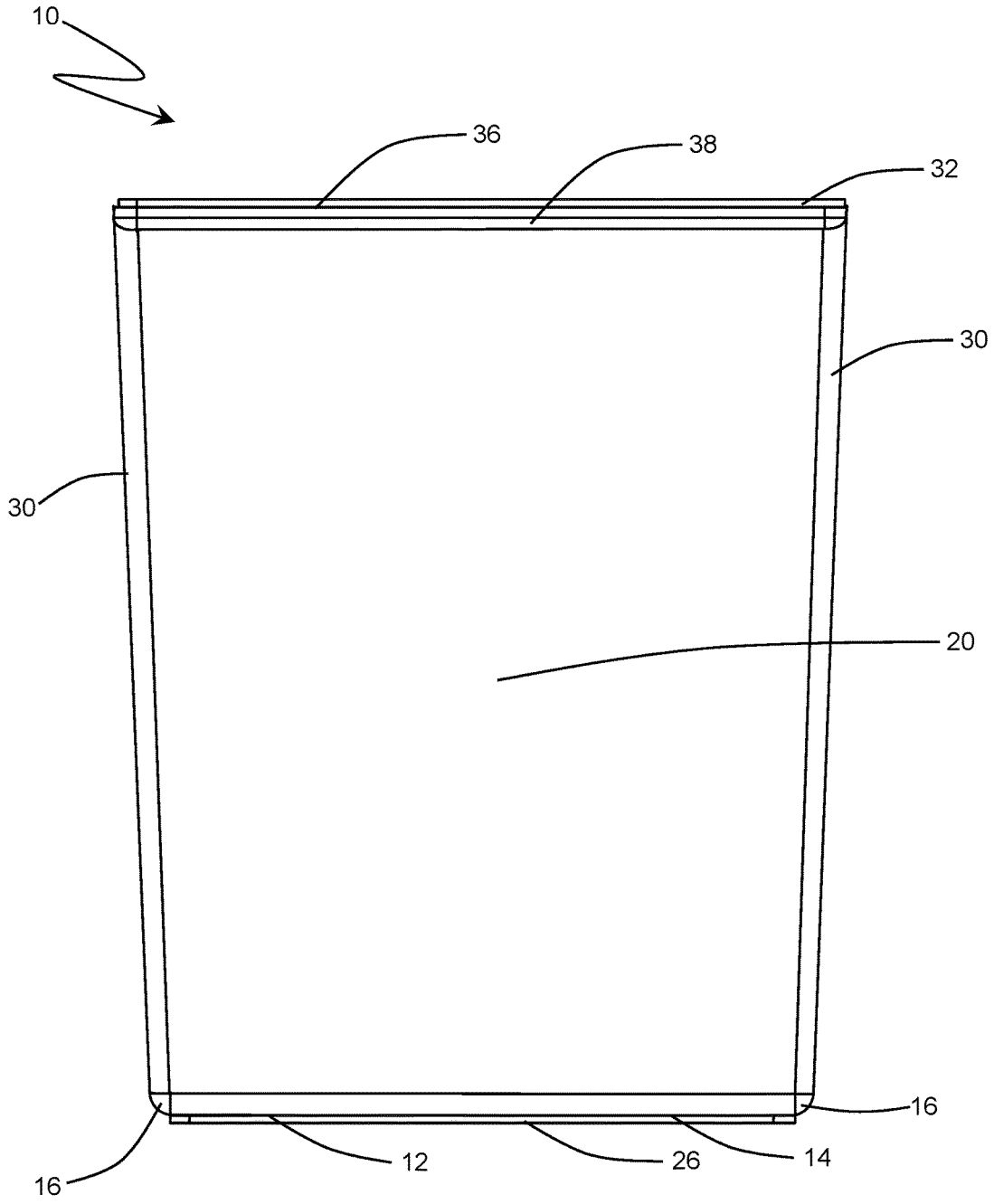
FIG. 4 in a rear view of the cremation urn according to an embodiment of the present invention.
Figure 5:
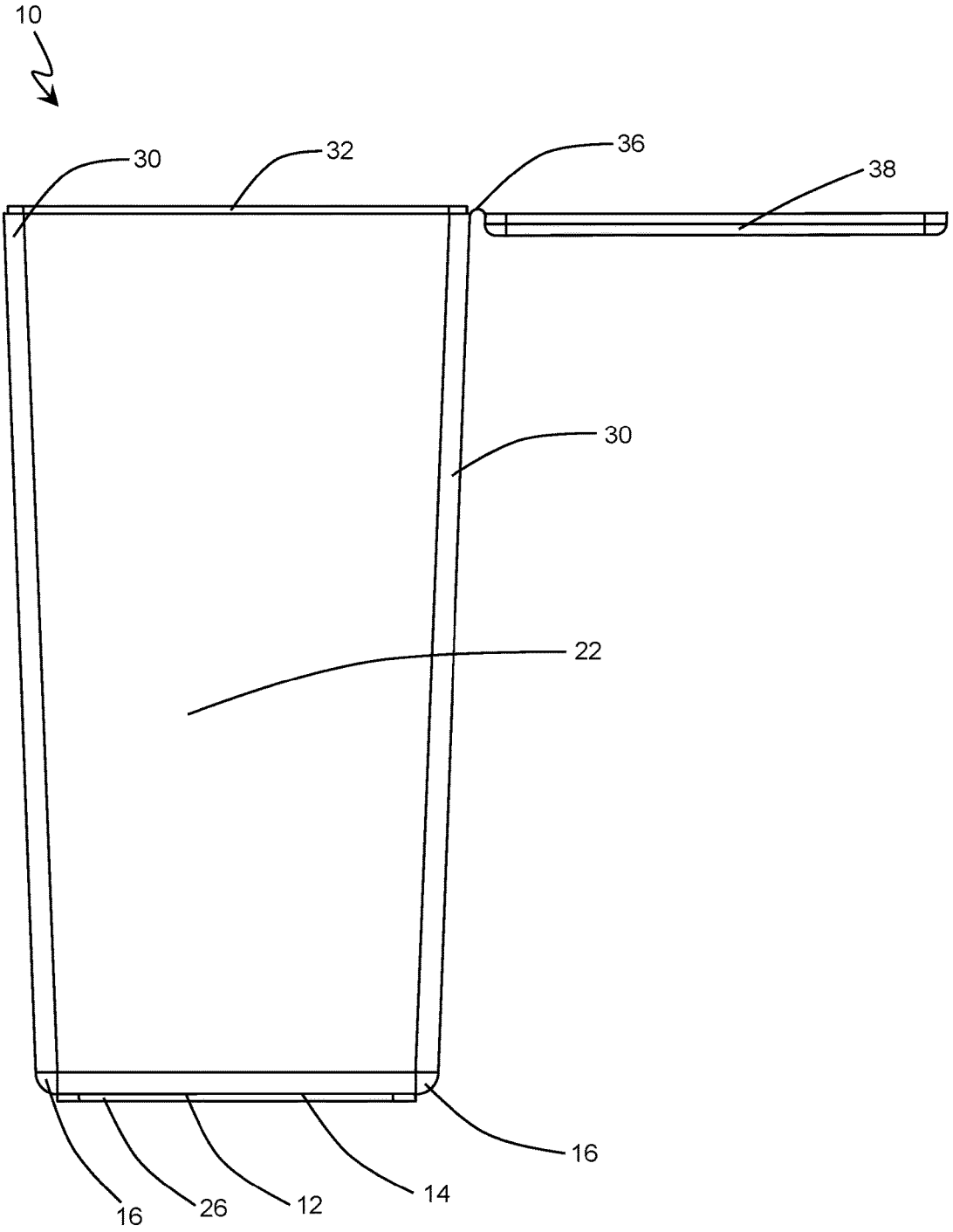
FIG. 5 is a second side view of the cremation urn according to an embodiment of the present invention.
Figure 6:
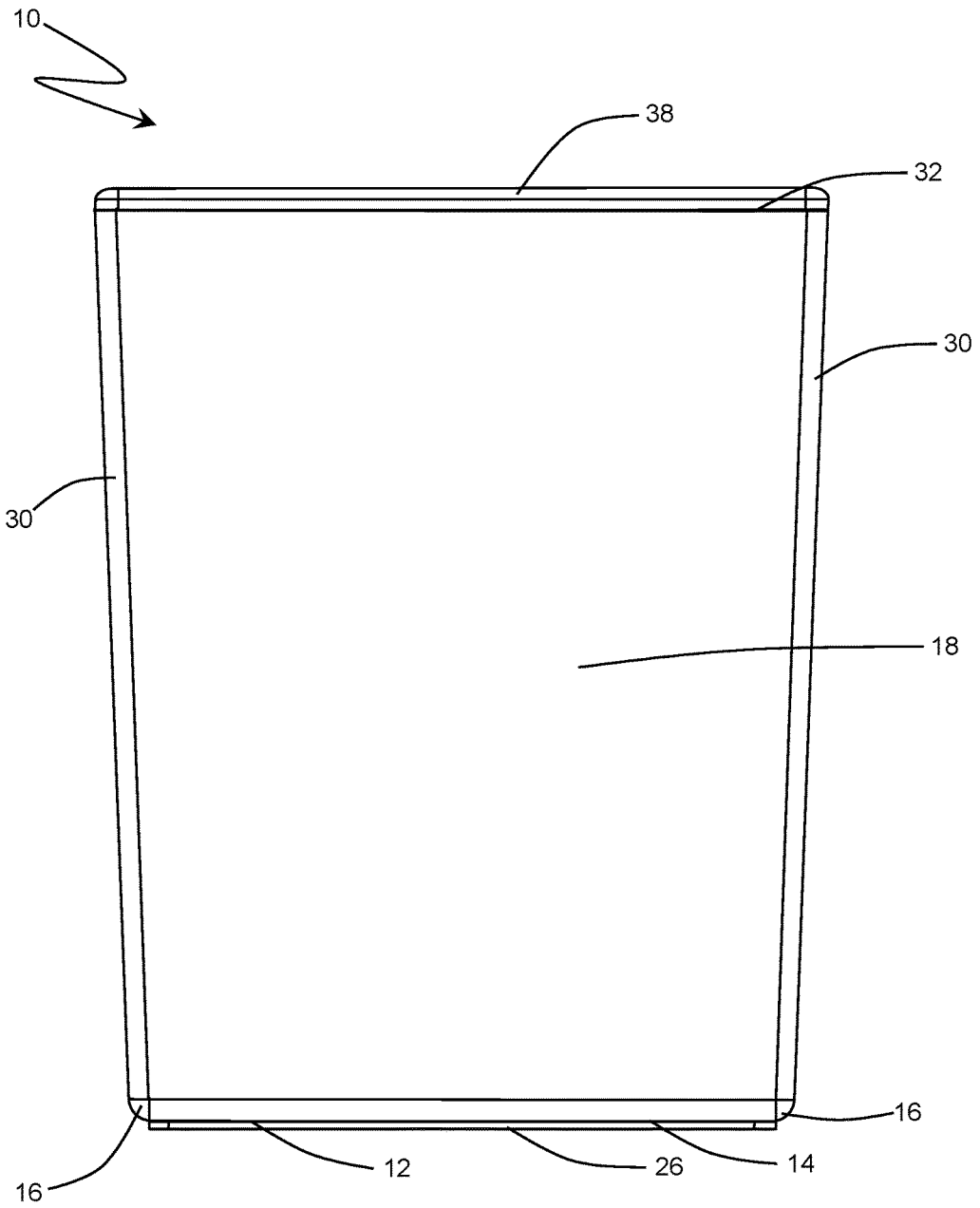
FIG. 6 is a front view of the cremation urn according to an embodiment of the present invention.
Figure 7:
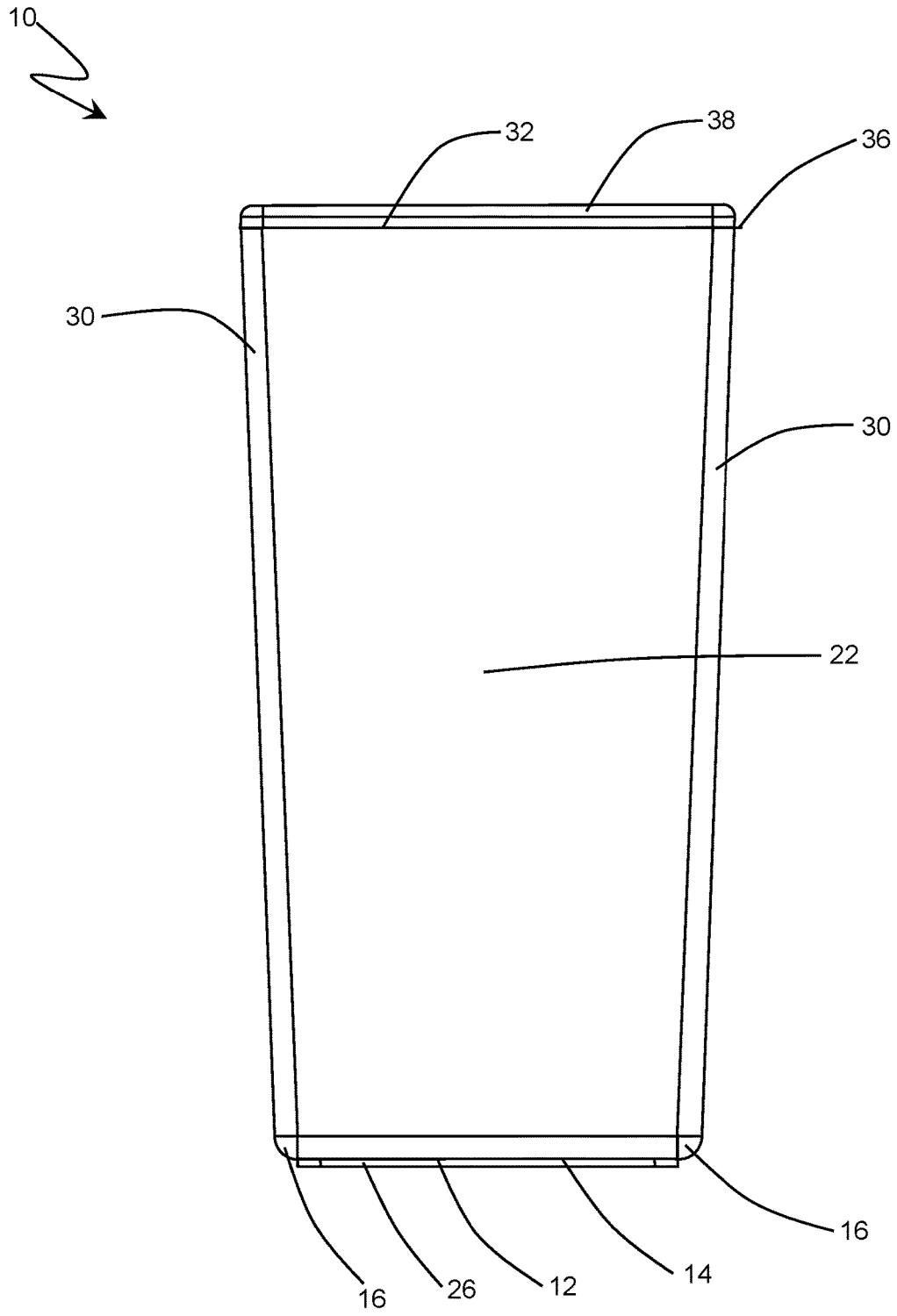
FIG. 7 is a first side view of the cremation urn according to an embodiment of the present invention.
Figure 8:
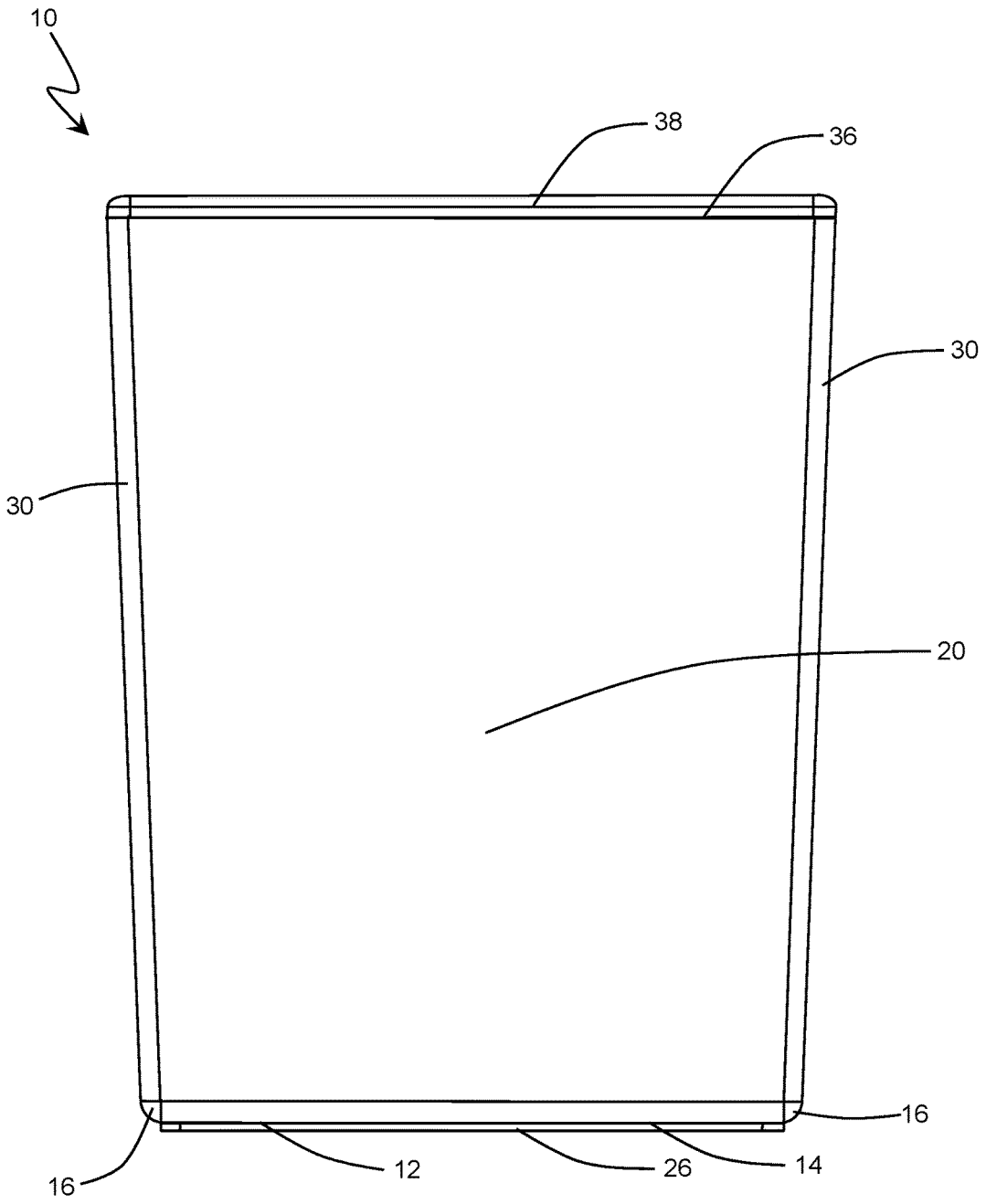
FIG. 8 in a rear view of the cremation urn according to an embodiment of the present invention.
Figure 9:
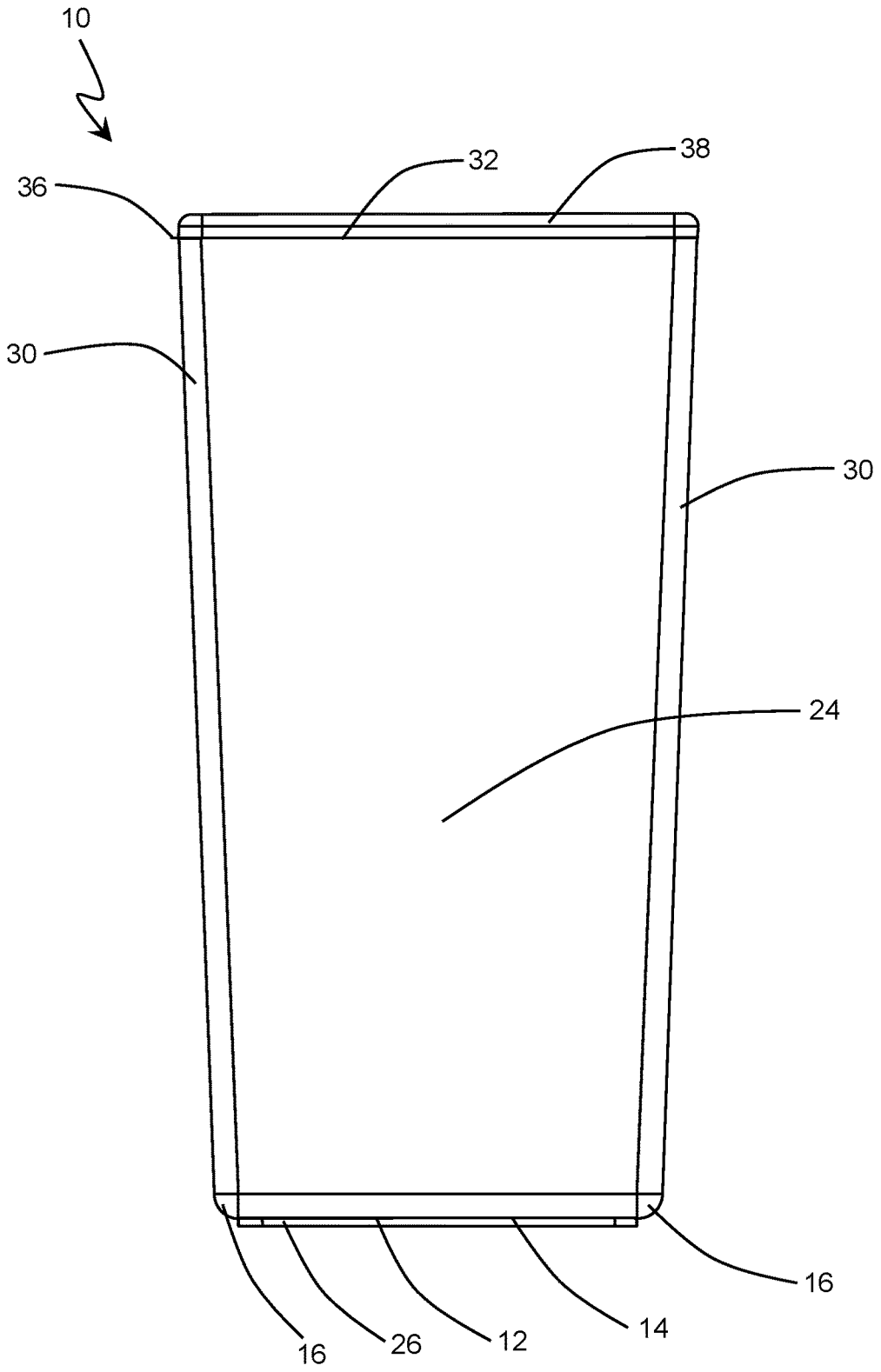
FIG. 9 is a second side view of the cremation urn according to an embodiment of the present invention.
Figure 10:
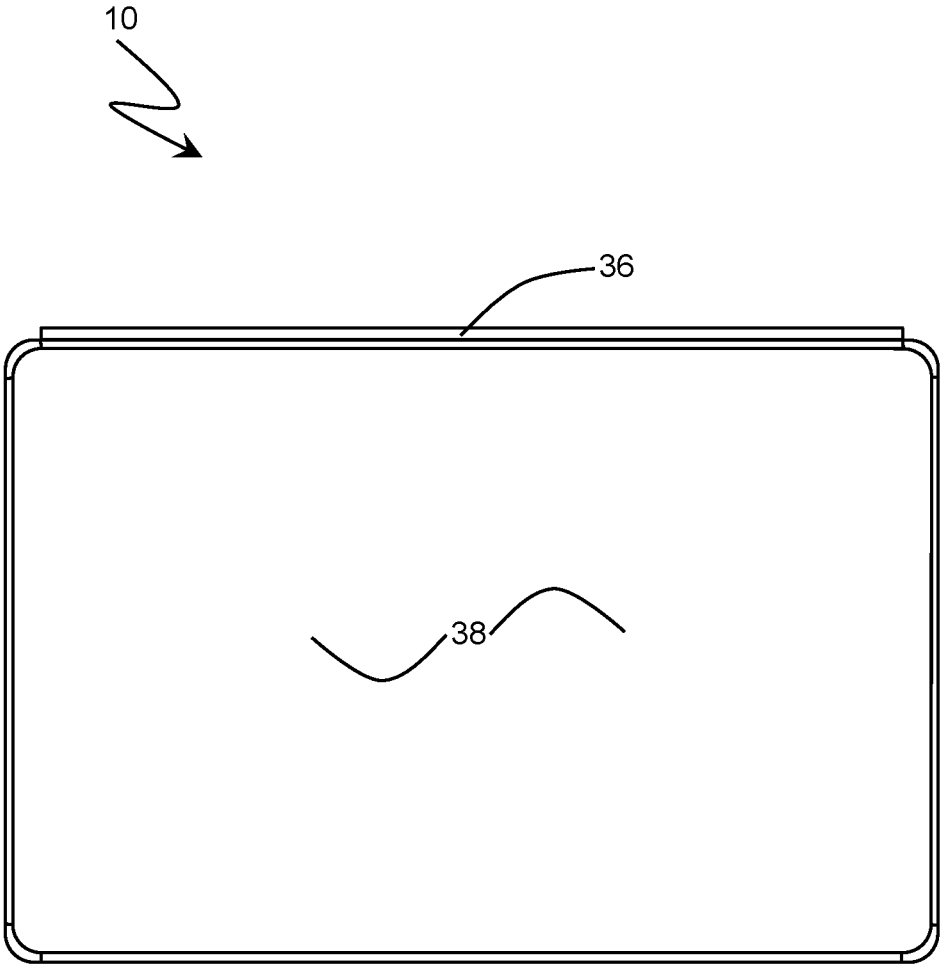
FIG. 10 is a top view of the cremation urn according to an embodiment of the present invention.
Figure 11:
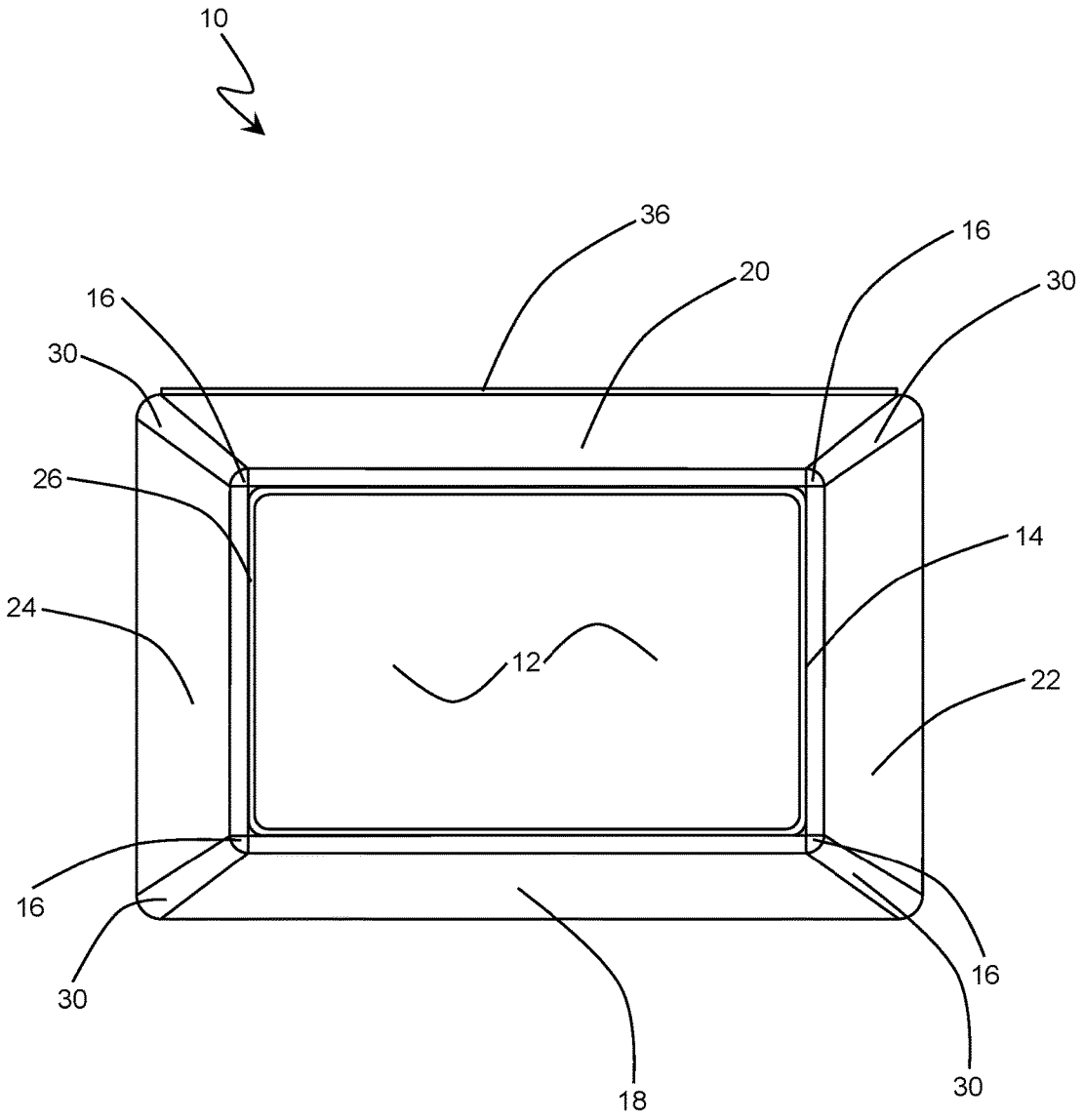
FIG. 11 is a bottom view of the cremation urn according to an embodiment of the present invention.
Figure 17A:
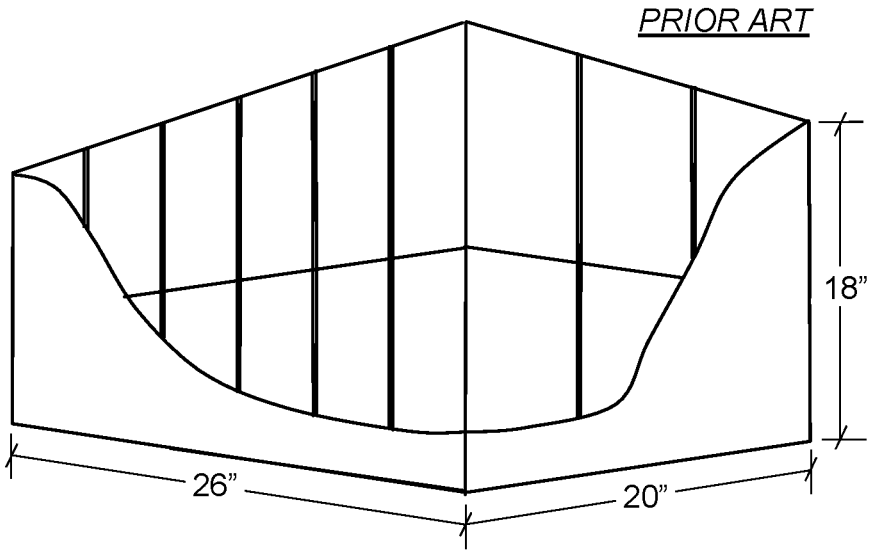
FIG. 17A is a perspective view of a shipping configuration for a prior art cremation urn.

Each of front wall 18, rear wall 20 and side walls 22, 24 extend upward from base 12 at an angle θ that is greater than zero degrees relative to an imaginary perpendicular line that extends from rim 32 to edge 14 of base 12 (Illustrated in FIG. 2 for front wall 18 and rear wall 20 and in FIG. 3 for side walls 22, 24). Having a draft angle or tapering of each of front wall 18, rear wall 20 and side walls 22, 24 ensures that area of base 12 will be smaller than the area of top opening 34 such that base 12 and a portion of each of front wall 18, rear wall 20 and side walls 22, 24 of a second urn 10' may pass through top opening 34 of a first urn. Configuring urn 10 in this manner will enable multiple urns to be nested together for ease of shipping and storage while each urn maintains a similar volume to prior art urns. If a draft angle or taper were not included in each of front wall 18, rear wall 20 and side walls 22, 24 of urn 10, multiple urns could not be nested together and would have to be stacked, a second urn on top of a first urn, thus leading to the shipping and storage issues of the present design (See e.g. FIG. 17A for stacking of prior art urns).

Figure 12:
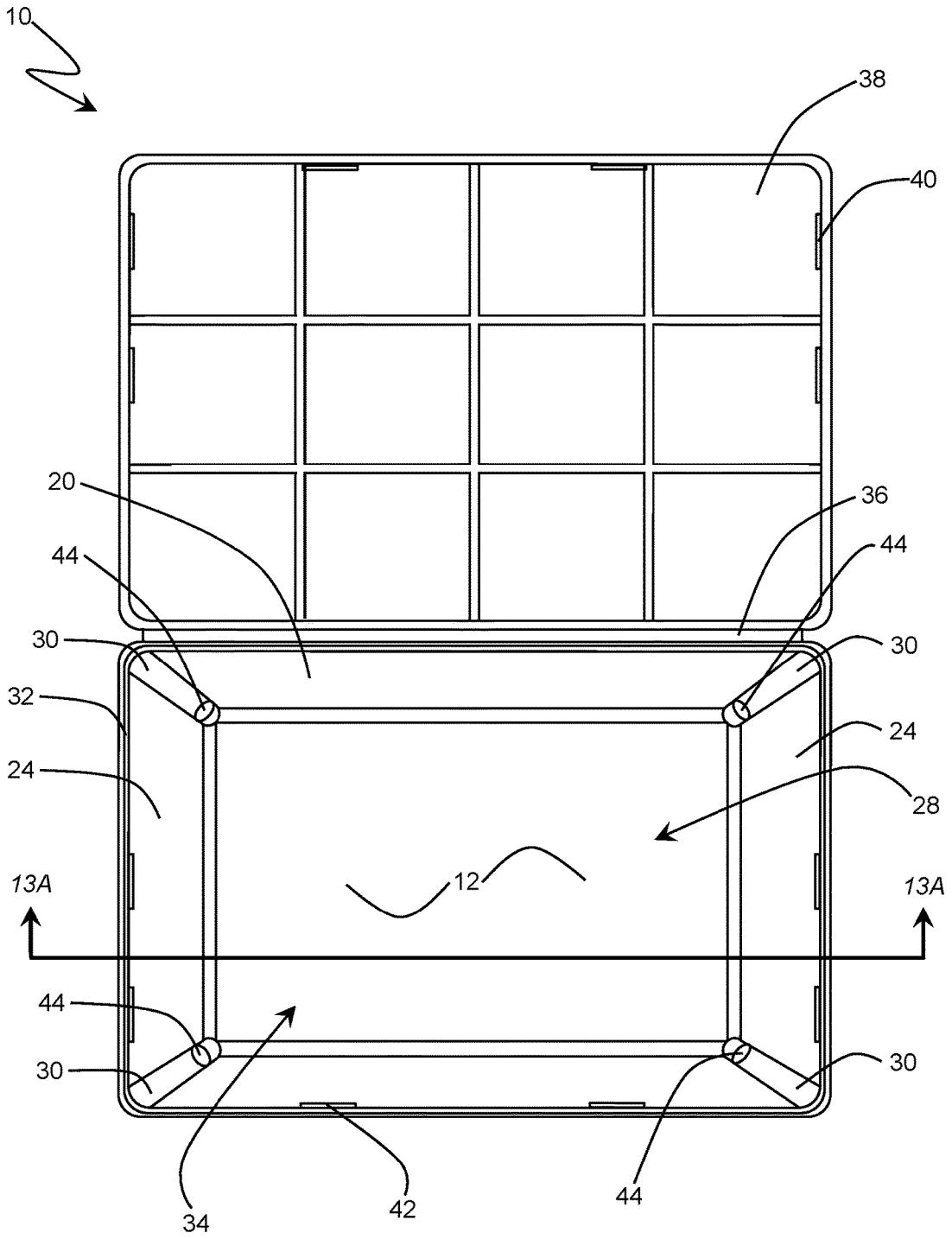
FIG. 12 is a plan view of the cremation urn illustrating the interior of the urn according to an embodiment of the present invention.
Figure 13A:
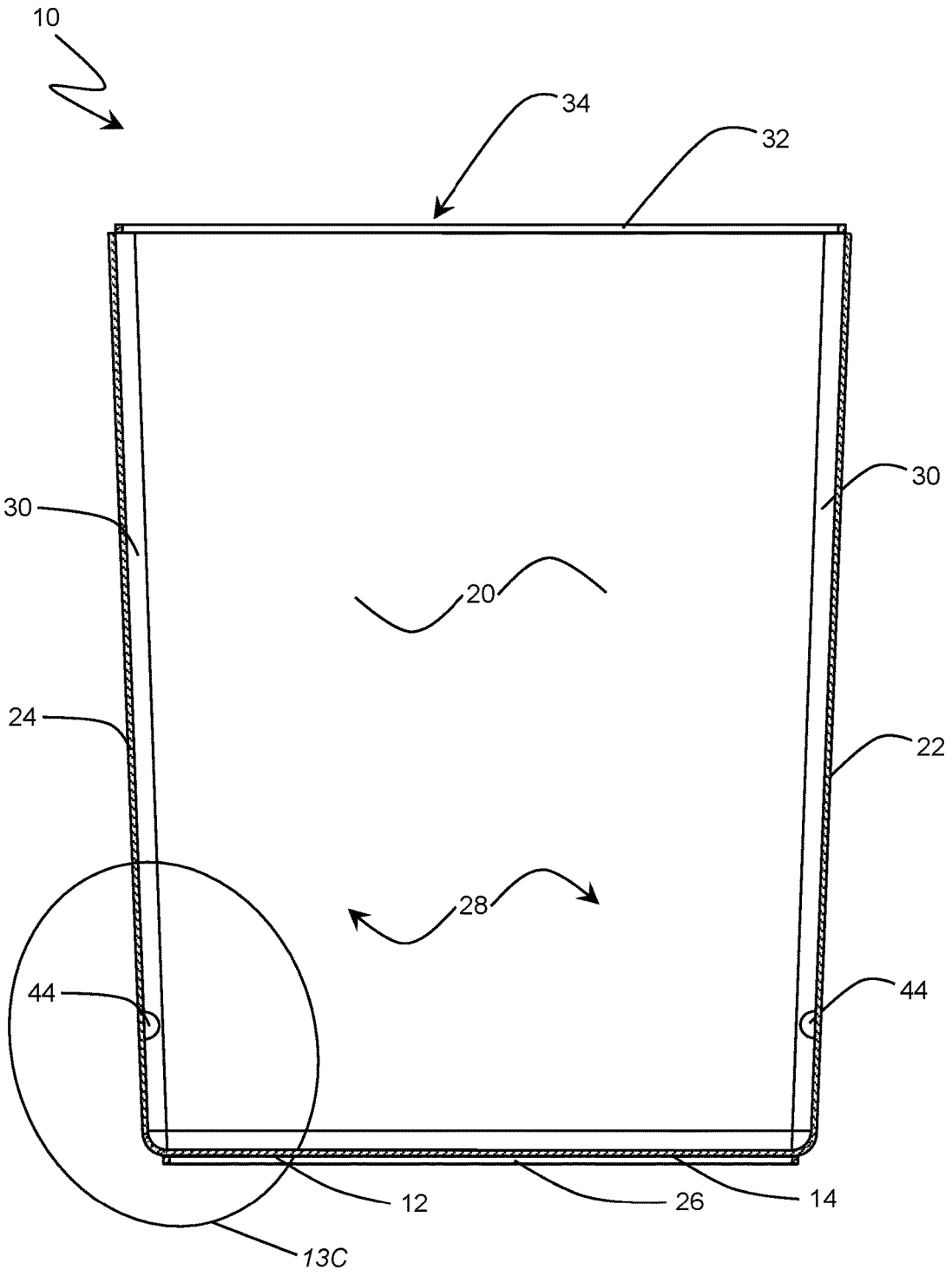
FIG. 13A is a front cross-sectional view of the cremation urn of FIG. 12 according to an embodiment of the present invention.
Figure 13B:
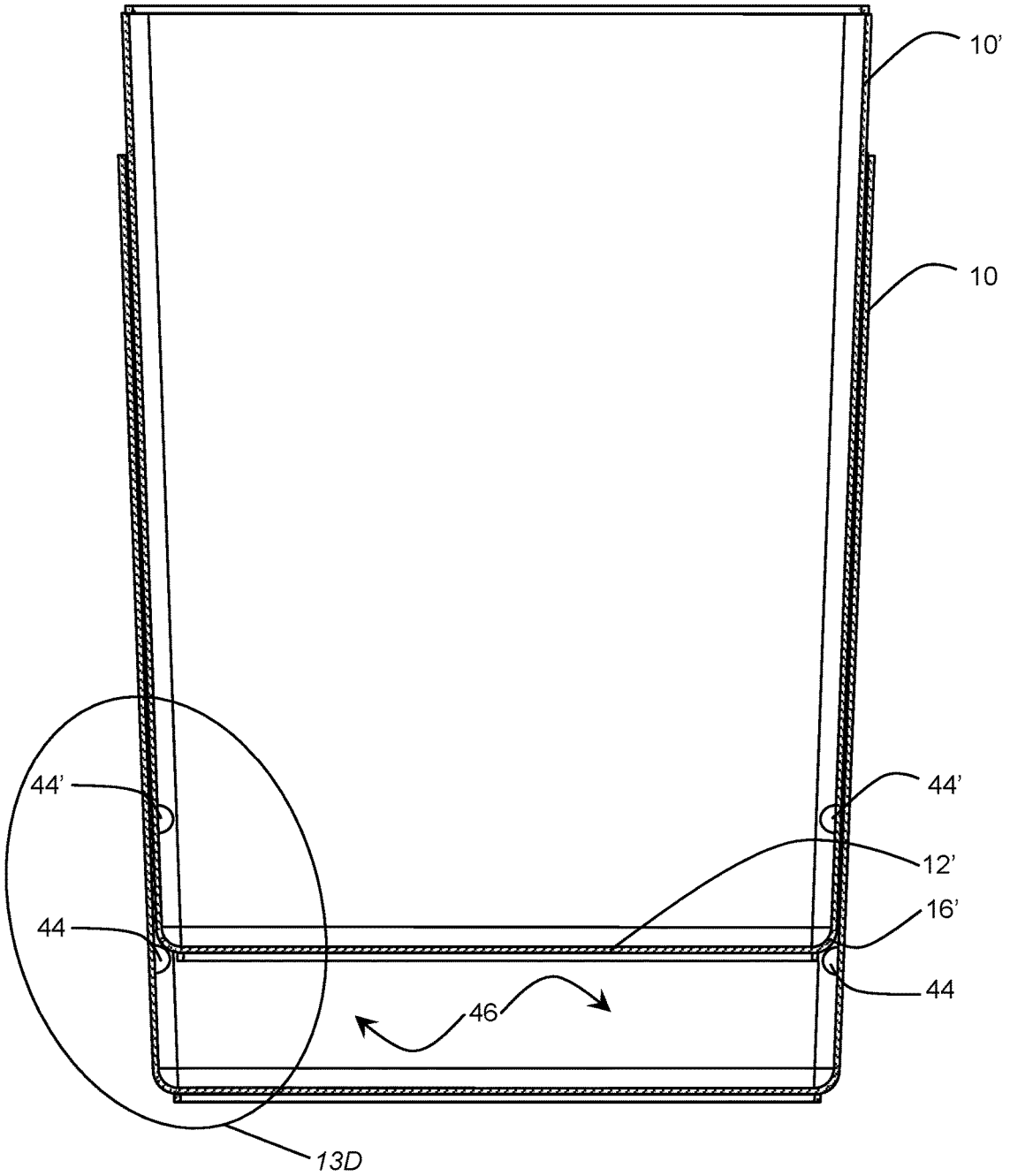
FIG. 13B is a front cross-sectional view of two cremation urns illustrating a second urn nested within a first urn according to an embodiment of the present invention.
Figure 13C:
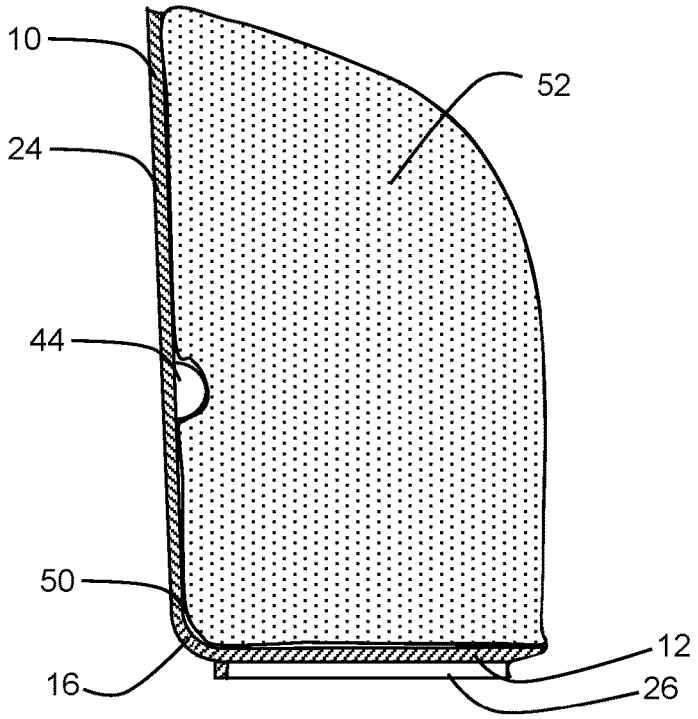
FIG. 13C is a exploded front cross-sectional view of the cremation urn of FIG. 13A illustrating the impact of a stop on a flexible container of cremated remains according to an embodiment of the present invention.
Figure 13D:
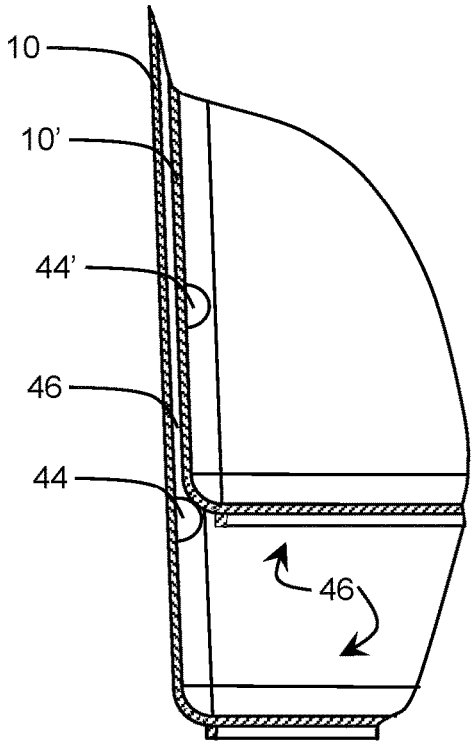
FIG. 13D is an exploded cross-sectional view of two cremation urns of FIG. 13B illustrating the second urn nested in the first urn and further illustrating an air gap created by the stop according to an embodiment of the present invention.
Figure 13E:
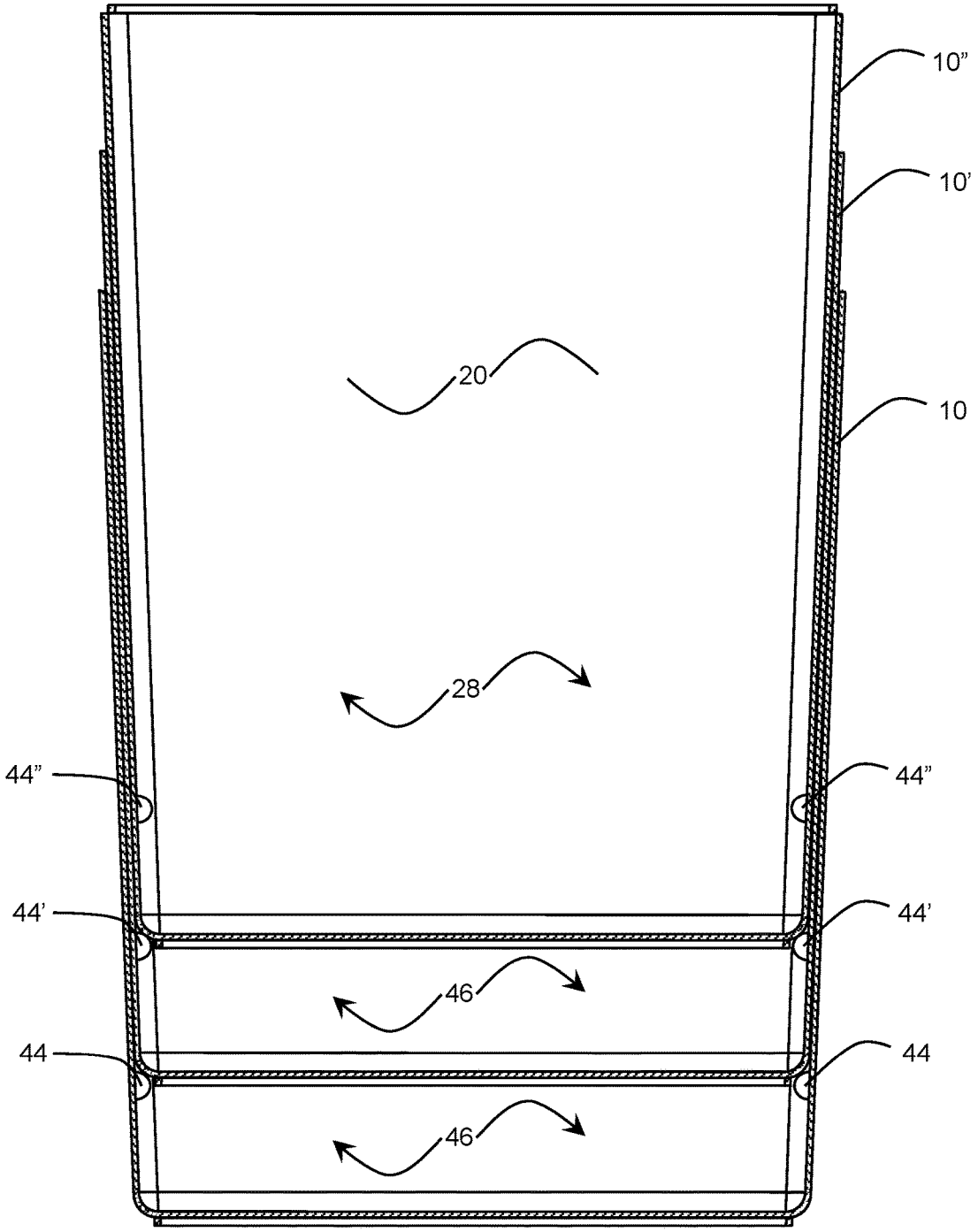
FIG. 13E is a front cross-sectional view of three cremation urns illustrating a third urn nested within the second urn that is nested within the first urn according to an embodiment of the present invention.

As depicted in FIGS. 12-13E, interior cavity 34 may include at least one stop 44. Stops 44 may be positioned at each of four corner beads 30 on an interior wall of urn 10. Stops 44 may be formed through a standard molding process on the interior of corner beads 30 a distance above base 12. Stops 44 may protrude outward from corner beads 30 toward the interior of cavity 34 and may be shaped as a semi-circle or bubble, square or other suitable shape. Stops 44 of first urn 10 are configured to engage edge 14 of second urn 10' at corner beads 30 when multiple urns are nested together for ease of shipping and storage.

Stops 44 may help to ensure that second urn 10', when nested inside first urn 10, maintains a set position inside first urn 10. Stops 44 will position second urn 10' within first urn 10 such that an air gap 46 is maintained between the outer walls of second urn 10' and the interior walls of first urn 10 (See FIGS. 13B, 13D and 13E). Air gap 46 will ensure the free flow of air between first urn 10 and second urn 10' to enable second urn 10' to be easily nested within first urn 10. As second urn 10' is lowed into interior cavity 28 of first urn 10, the air that filled interior cavity 28 of first urn 10 is displaced as second urn 10' is lowered further and further into interior cavity 28 of first urn 10. As second urn 10' descends further into first urn 10, edge 14' of base 12' of second urn 10' nears stops 44 of first urn 10 and air continues to escape from interior cavity 34 of first urn 10 through air gap 46. Edge 14' of base 12' of second urn 10' rests against stops 44 of first urn 10 and second urn 10' is nested within first urn 10 for ease of shipping and stowage.

Stops 44 and air gap 46 will also facilitate the ease of separation of second urn 10' from first urn 10. As stated above, air gap 46 created by stops 44 enables the free flow of air between second urn 10' and first urn 10 when second urn 10' is nested within interior cavity 28 of first urn 10. The airflow through air gap 46 allows for second urn 10' to be easily removed from the interior cavity 28 of first urn 10 by simply pulling second urn 10' away from first urn 10. If stops 44 were not included in first urn 10, second urn 10' may be pushed to far into interior cavity 28 of first urn 10 such that air gap 46 would be eliminated thus limiting or stopping any airflow between second urn 10' and the first urn 10. Without adequate airflow between the two urns, a vacuum may be created between an exterior of base 12' of second urn 10' and the interior of base 12 of first urn 10 when second urn 10' is being pulled away from first urn 10. This vacuum between the two urns will make it very difficult to separate the two urns and an alternative means of airflow, such as a hole in base 12 of first urn 10 may have to be introduced to allow air flow into internal cavity 28 to enable the separation of second urn 10' from the first urn 10.

The top portion of stops 44 may be rounded or blunt to ensure that any item added to the interior cavity 28 of urn 10 is not damaged. Typically, cremated remains 52 are stored temporarily in a standard plastic bag 50 or other similar material that is flexible and impervious to moisture. Plastic bag 50 may be placed into interior cavity 28 of urn 10. A rounded or blunt stop 44 will not damage plastic bag 50 and will not cause the contents of the bag to leak out as illustrated in FIG. 13C. If stops 44 were to have any sharp components in any manner, there may be a risk to a puncture of the bag and spillage contents when the bag is introduced into interior cavity 28 of urn 10.

FIG. 13E illustrates how more that two urns may be nested together. In this illustration, three urns, first urn 10, second urn 10' and third urn 10" are shown nested together. It is important to note that any number of urns may be nested together to improving the shipping and storage limitations of any of the prior art urns.

Figure 14:
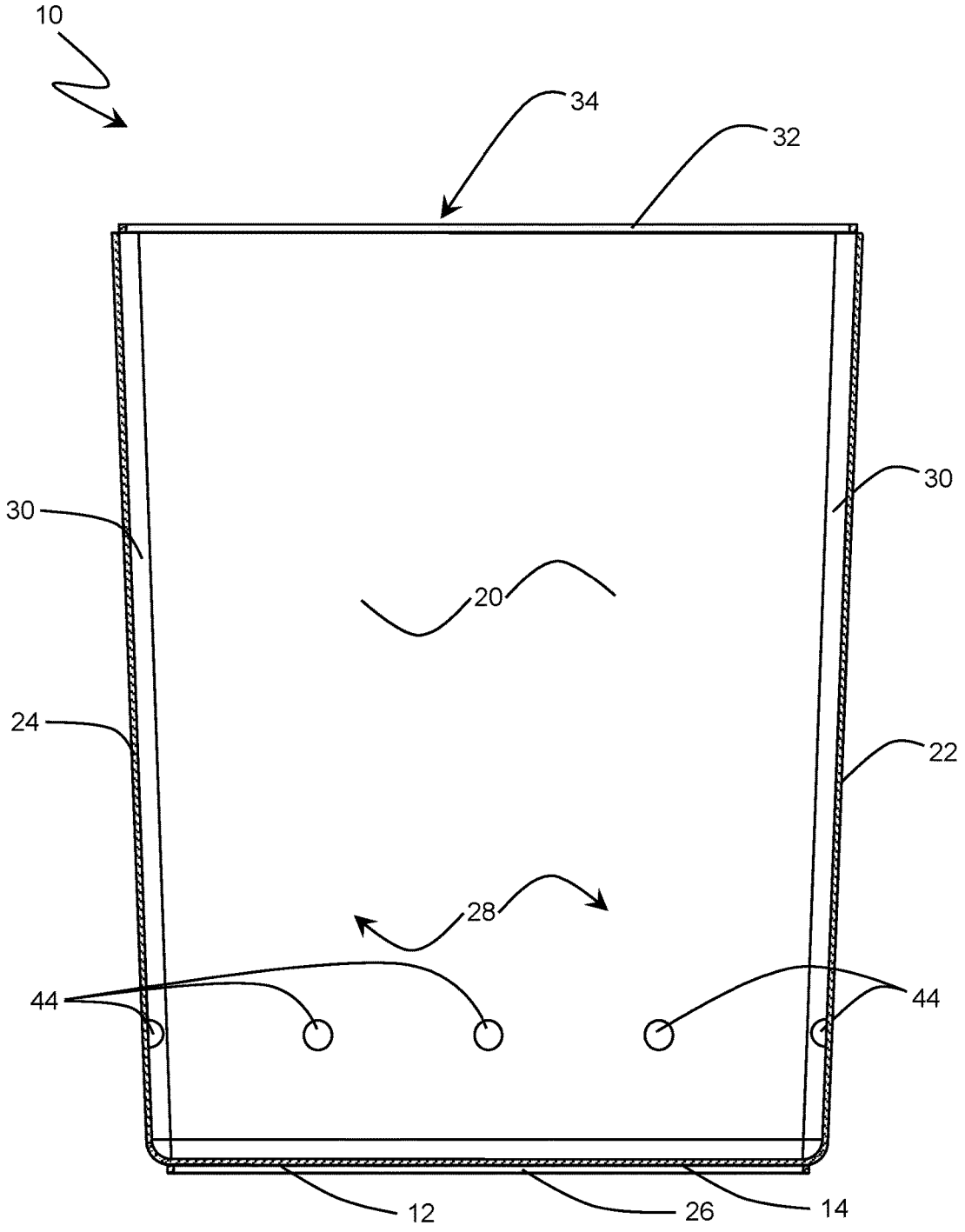
FIG. 14 is a front cross-sectional view of the cremation urn according to another embodiment of the present invention.

As described above, stops 44 are disposed on the interior walls of urn 10 at each of the four corner beads 30 and positioned a distance above base 12. Stops 44 may be positioned in this manner to facilitate the nesting of a portion of second urn 10' within interior cavity 28 of first urn 10. Further, stops 44 are positioned within the interior cavity 28 to ensure air gap 46 is created between the outer walls of second urn 10' and the interior walls of first urn 10 to ensure ease of removal of second urn 10' from first urn 10. It is important to note, however, that stops 44 may be disposed at any location along the interior of any configuration as long as stops 44 are positioned a distance above base 12 such that air gap 46 between the outer walls of second urn 10' and the inner walls of first urn 10 is created and maintained when second urn 10' is introduced into first urn 10. In another embodiment of the present invention, stops 44 may be disposed on the interior of front wall 18, rear wall 20 or sidewalls 22, 24. FIG. 14 illustrates an alternative location of stops 44 in interior cavity 28 on rear wall 20 of urn 10.

Figure 15:
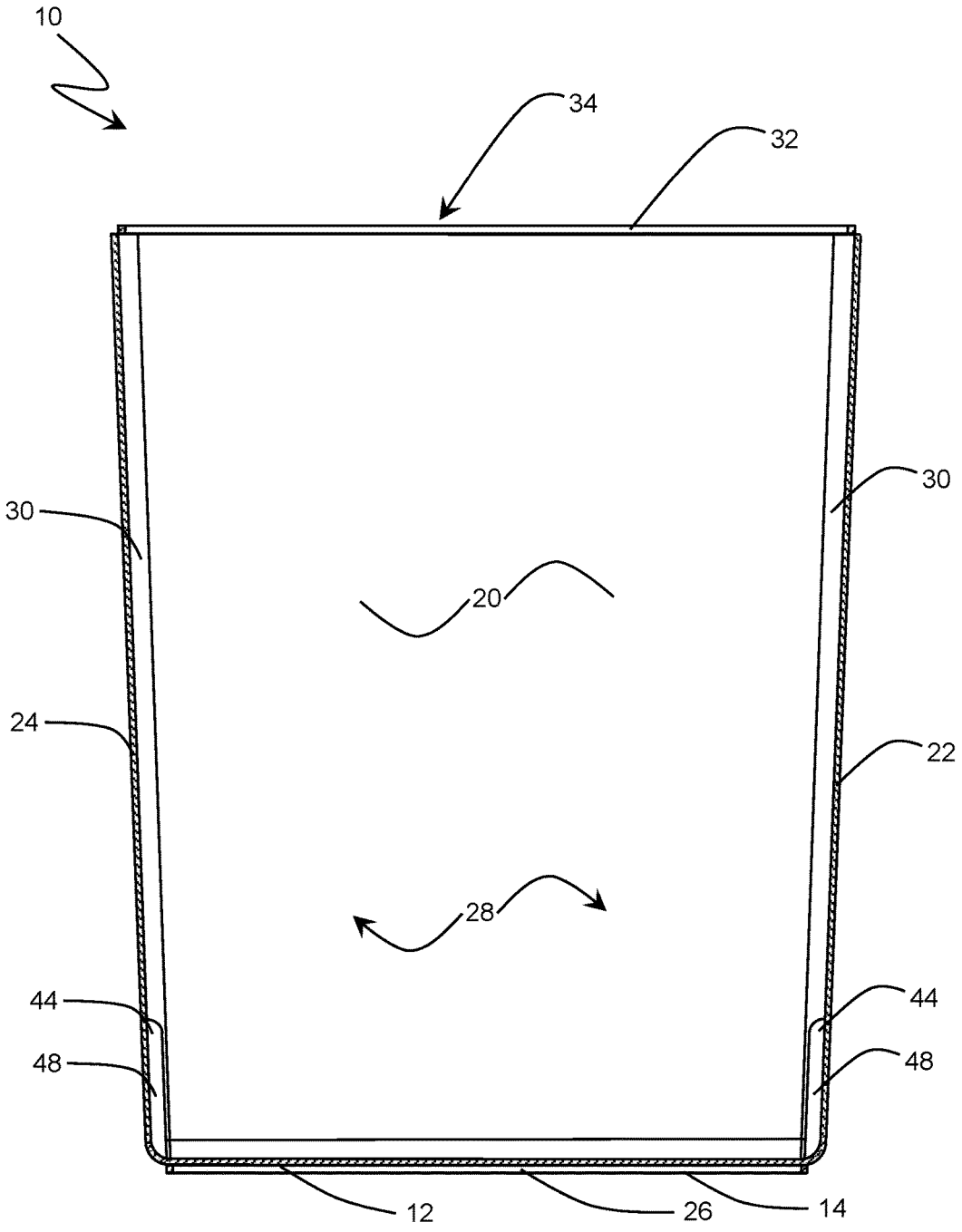
FIG. 15 is a front cross-sectional view of the cremation urn according to yet another embodiment of the present invention.

In yet another embodiment of the present invention depicted in FIG. 15, stops 44 may be configured such that stops 44 may include a post 48 that extends from base 12 at edge 14 to a predetermined position as discussed above to still ensure that air gap 46 is created and maintained between the outer walls of second urn 10' and the inner walls of first urn 10. Stops 44 and posts 48 may be rounded or blunt as described above such that the rounded or blunt stop 44 and post 48 will not damage plastic bag 50 and will not cause the contents of the bag to leak out when the bag is introduced into urn 10.

Figure 16:
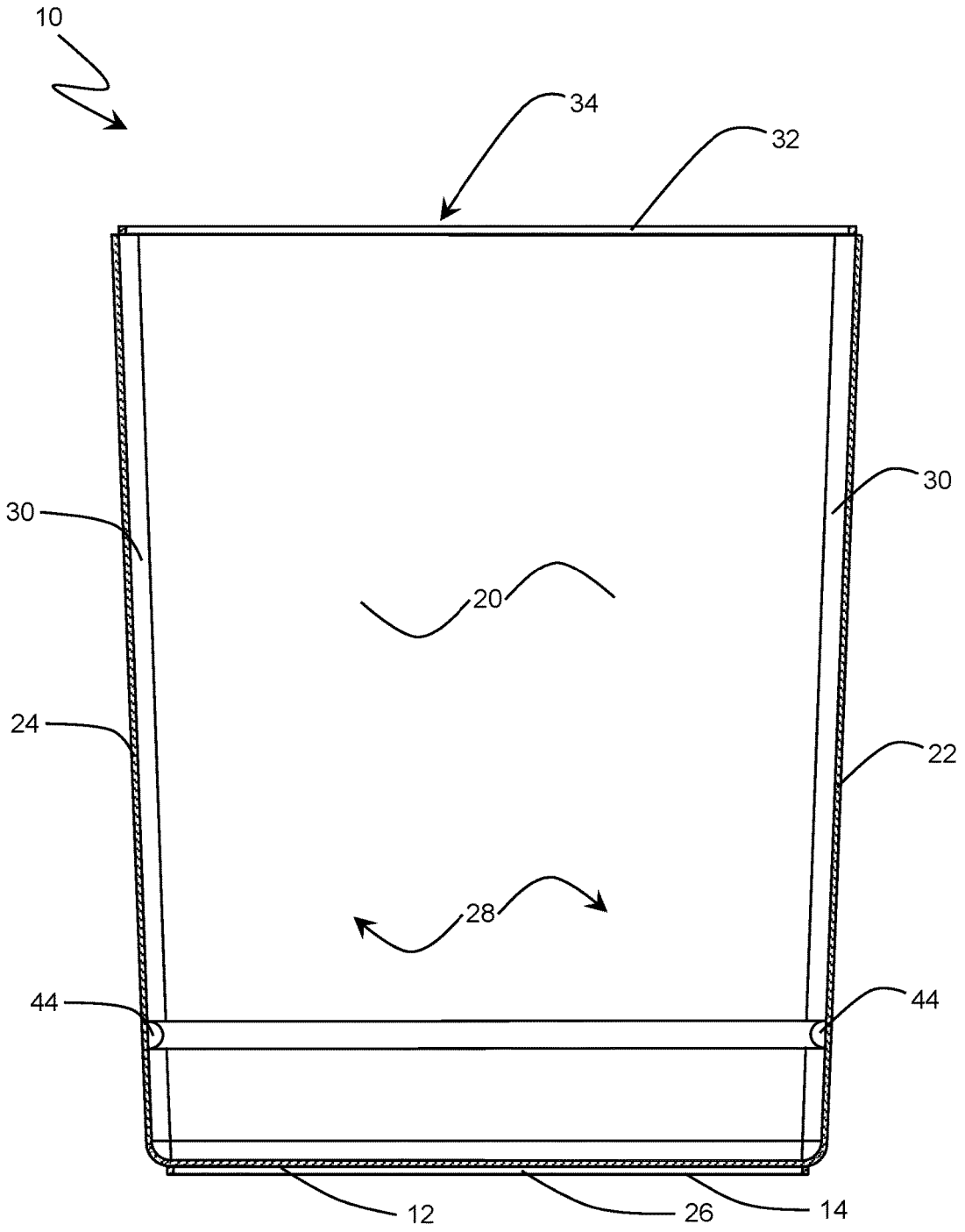
FIG. 16 is a front cross-sectional view of the cremation urn according to still another embodiment of the present invention.

In still another embodiment of the present invention illustrated in FIG. 16, stop 44 may extend around the entire interior perimeter of interior cavity 28 and protrude outward from the interior of front wall 18, rear wall 20 and side walls 22, 24. Stop 44 may be positioned as discussed above to still ensure that air gap 46 is created and maintained between the outer walls of second urn 10' and the inner walls of first urn 10. Stop 44 may be rounded or blunt as described above such that the rounded or blunt stop 44 will not damage plastic bag 50 and will not cause the contents of the bag to leak out when the bag is introduced into urn 10.

It is important to note, that stops 44 may be of any shape, size or configuration and still serve the same purpose of allowing second urn 10' to nest within interior cavity 28 of first urn 10 for increased ease of shipping and storage while at the same time creating air gap 46 to allow second urn 10' to be easily separated from first urn 10. Still further, stops 44 may also be of any shape, size or configuration to facilitate an inexpensive and robust molding process as each urn is manufactured.

Urn 10 may be manufactured from any number of plastic polymers such as polyethylene, polypropylene, polystyrene and the like. Materials used to in urns should be easily moldable and able to seal out moisture when the urn is completely closed and sealed. The materials should also be cost effective to work with and produce an urn that will not degrade over time.

Urn 10 may be configured to have the following dimensions. It is important to note that these dimensions are typical dimensions for an urn. Dimensions can be modified in any manner and still maintain the inventive embodiments discussed above. Urn 10 may be 8.5 inches in height and have top opening 35 configured to be 6.5 inches wide and 4.5 inches in depth. Urn 10 may include a taper or draft angle θ of approximately five degrees to configure base 12 to be 5 inches wide and 3 inches in depth. Lid 38 may be configured to be 6.5 inches wide and 4.5 inches in depth to ensure lid 38 may seal against top opening 34 and securely lock lid 38 to rim 32. Front wall 18, rear wall 20, side walls 22, 24, base 12 and lid 38 may all have a thickness of 0.080 inches. The center of stops 44 may be positioned 1.25 inches above the outside dimensions of base 12. As stated above, it is important to note that these dimensions are merely examples given to provide a size for a sample urn. The dimensions may be modified to develop a suitable size urn for any use yet maintain the inventive embodiments of nesting urns for ease of shipping and storage described above.

Figure 17B:
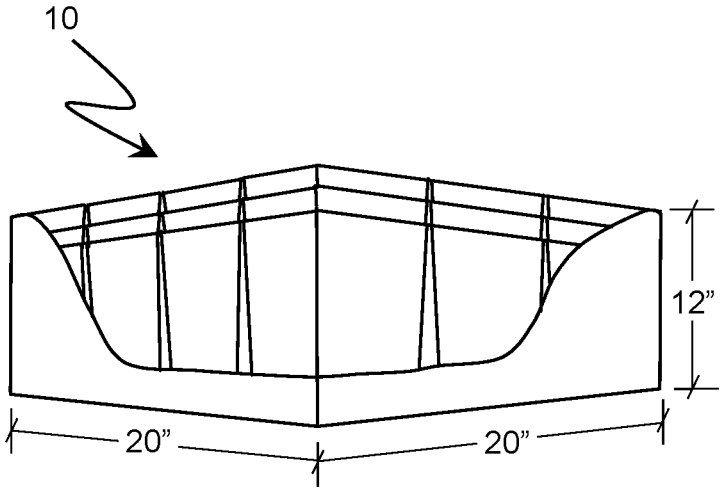
FIG. 17B is a perspective view of a shipping configuration for the cremation urn according to an embodiment of the present invention.

Typical prior art urn designs do not allow for the nesting of urns within one another. Prior art urns require that the urns be stacked one on top of another for shipping and storage. Prior art urns are shipped in standard cardboard boxes and usually shipped in units of 36. This creates a shipping container having rather large dimensions (18 inches in height×26 inches in width×20 inches in depth) (See FIG. 17A). Shipping a box of 36 urns displaces over 9,000 cubic inches or over 5.4 cubic feet of volume and weighs approximately 28 pounds. While the weight of the shipping container is relatively light, shipping a box of this size is very cumbersome to handle which results in added costs for manufacturer and end-user. There are also added costs to storing these large boxes for the end user. The revised urn design provided by the inventive embodiments above allows for the nesting of one urn inside another and enables the same number of 36 urns to be shipped in a much smaller shipping container having dimensions of 12 inches in height×20 inches in width×20 inches in depth (See FIG. 17B). Shipping a box of 36 urns in this manner displaces only 4,800 cubic inches or under 2.8 cubic feet of volume and yet still weighs approximately 28 pounds. A reduction by almost one-half the dimensions of the prior art urns. Shipping costs may be reduced by approximately one-half when the revised urn design provided by the inventive embodiments above allow for the nesting of one urn inside another.

The present invention has been particularly shown and described with reference to the foregoing embodiment, which is merely illustrative of the best modes presently known for carrying out the invention. It should be understood by those skilled in the art that various alternatives to the embodiment of the invention described herein may be employed in practicing the invention without departing from the spirit and scope of the invention as defined in the following claims. It is intended that the following claims define the scope of the invention and that the method within the scope of these claims and their equivalents be covered thereby. This description of the invention should be understood to include all novel and non-obvious combination of elements described herein, and claims may be presented in this or a later application to any novel non-obvious combination of these elements. Moreover, the foregoing embodiment is illustrative, and no single feature or element is essential to all possible combinations that may be claimed in this or a later application.

What is claimed is:

1. A cremation urn for storing cremated remains, includes:

a base, said base including an edge that extends a perimeter of said base;

a front wall, said front wall extending generally upward at a first outward angle from said edge of said base;

a rear wall, said rear wall extending generally upward at a second outward angle from said edge of said base, said rear wall opposite said front wall;

a first side wall extending generally upward at a third outward angle from said edge of said base, said first side wall intersecting said front wall and said rear wall;

a second side wall extending generally upward at a fourth outward angle from said edge of said base, said second side wall opposite said first side wall and said second side wall intersecting said front wall and said rear wall;

a top opening, said top opening created at a top of said front wall, said rear wall, said first side wall and said second side wall;

a lid, said lid covering said top opening;

a hinge, said hinge connected to said lid and said rear wall;

an interior cavity for receiving the cremated remains, said interior cavity created by the interior intersection of said front wall to said first side wall, said front wall to said second side wall, said rear wall to said first side wall, said rear wall to said second side wall and each of said front wall, said first side wall, said second side wall and said rear wall intersecting said edge of said base;

four corner beads, each of said corner beads configured at the intersection of said front wall to said side walls and said rear wall to said side walls and each of said four corner beads extending from said base to said top opening;

a plurality of stops, said plurality of stops positioned a distance above said base and said plurality of stops fixedly secured to each of said corner beads within said interior cavity and said plurality of stops including a rounded edge; and wherein said front wall, said rear wall, said first side wall and said second side wall extend generally upward at said first outward angle, said second outward angle, said third outward angle and said fourth outward angle respectively from said base to said top opening to create a taper in said cremation urn;

wherein the tapering of said front wall, said rear wall, said first side wall and said second side wall enable a second cremation urn to pass through said top opening of said cremation urn to be nested within said interior cavity of said cremation urn;

wherein a second edge of a second base of said second cremation urn engages said plurality of stops of said cremation urn to facilitate the nesting and unnesting of multiple said cremation urns; and wherein said second cremation urn rests freely within said interior cavity abutting said plurality of stops of said cremation urn to further facilitate the effortless removal of said second cremation urn from said interior cavity of said cremation urn.

2. The cremation urn as recited in claim 1, wherein an air gap is created between the interior of said front wall, said rear wall, said first side wall, said second side wall and said base of said cremation urn and the exterior of said front wall, said rear wall, said first side wall, said second side wall and said base of said second cremation urn as said second edge of said second cremation urn rests upon said stop of said cremation urn.

3. The cremation urn as recited in claim 1, wherein each of said plurality of stops include a post, each of said posts are fixedly secured to each of said corner beads within said interior cavity.

* * * * *